United States Patent [19]

DeHart

[11] 4,016,708

[45] Apr. 12, 1977

[54] ENVELOPE PROCESSING MACHINE

[75] Inventor: John R. DeHart, Coral Gables, Fla.

[73] Assignee: Docutronix, Inc., Homestead, Fla.

[22] Filed: Aug. 13, 1975

[21] Appl. No.: 604,249

Related U.S. Application Data

[63] Continuation-in-part of Ser. No. 496,977, Aug. 13, 1974, abandoned.

[52] U.S. Cl. ..... 53/381 R; 53/386; 83/1; 83/430; 83/912

[51] Int. Cl.[2] ..... B65B 43/30

[58] Field of Search ..... 53/381 R, 386; 83/430, 83/912, 506, 262, 54, 425.2, 425.3, 425.4, 262

[56] References Cited

UNITED STATES PATENTS

| | | | |
|---|---|---|---|
| 244,845 | 7/1881 | Bowles | 83/430 X |
| 2,019,499 | 11/1935 | Maher | 83/430 X |
| 2,360,653 | 10/1944 | Davidson | 83/506 |
| 3,116,718 | 1/1964 | Krupotich et al. | 53/381 R |
| 3,153,853 | 10/1964 | Lipton | 83/912 X |
| 3,238,926 | 3/1966 | Huck | 53/381 R |
| 3,381,564 | 5/1968 | Whiteford | 83/912 X |
| 3,828,634 | 8/1974 | Luperti | 53/381 R |

*Primary Examiner*—Othell M. Simpson
*Assistant Examiner*—Horace M. Culver
*Attorney, Agent, or Firm*—McCormick, Paulding & Huber

[57] ABSTRACT

A table top extractor unit for removing contents from previously opened envelopes which have two panels connected along three side edges comprises a chadless cutter assembly and a vacuum feed mechanism for sequentially feeding envelopes to a transport conveyor which advances each successive envelope into the cutter assembly. The cutter assembly cuts through one panel of the envelope to sever the one panel from the other along opposite connected edges and simultaneously conveys the envelope to a vacuum separator drum located at the front end of the machine. The rotatable drum grips one panel of the envelope and carries the envelope past a stationary deflector or chute which enters between the envelope panels to cause the other panel to be folded back and into a trailing position relative to the one panel allowing the contents of the envelope to drop from juxtaposition between the panels and travel down the chute. An envelope conveyor receives the emptied envelope from the separator drum and conveys it to a two-position gate mechanism which in one position directs the envelope to and along one discharge path which terminates at the rear of the extractor. When the gate is in its other position, the emptied envelope is conveyed along another discharge path which terminates at the front end of the machine. A manual control is provided for moving the gate to its other position. A contents detection device associated with the envelope conveyor responds to the presence of envelope contents on the conveyor to move the gate to its other position. An envelope opening machine, also shown, has a chadless cutter assembly for opening an envelope by cutting through only one panel thereof.

41 Claims, 23 Drawing Figures

10
12
14
16
18
20
22
24
26
28
29
30
32
34
38
40
42
44
46
48
52
54
56
64
66
68
71
74
76
78
80
81
110
134
136
138
140
142
146
148
150
152
194
196
198
200
7
7
14
14

11
13
15
17
19
21
23
25
27
31a
31b
33
35
37
39
41
43
55
61
77
79
89

ENVELOPE PROCESSING MACHINE

CROSS REFERENCE TO RELATED APPLICATION

This application is a continuation-in-part of application Ser. No. 496,977 filed Aug. 13, 1974, and now abandoned.

BACKGROUND OF THE INVENTION

This invention relates in general to envelope processing machinery and deals more particularly with an improved envelope opening machine and with an improved extractor for removing contents from envelopes.

The large volume of business reply mail being handled today has created the need for automatic envelope processing machinery capable of processing large volumes of business reply envelopes to rapidly open envelopes and to remove and separate contents thereof. The general purpose of the present invention is to provide improved machines of the aforedescribed general type which open envelopes or which removes and separates contents from envelopes. The envelopes remain in one piece after being opened or being separated from the contents thereof to minimize production of scrap paper. A further aim of the invention is to provide an improved extractor for processing envelopes and which verifies that the contents have been removed from each envelope before the envelope is conveyed by the machine to a waste receptacle or the like. The extractor of the present invention is capable of compensating for minor variations in the dimensions of standard envelopes, as for example, folding errors which may have occurred during envelope manufacture so that such envelopes will not jam in the machine causing interruption in production.

SUMMARY OF THE INVENTION

In accordance with the present invention, improved envelope processing machinery is provided. An extractor embodying the invention removes contents from generally rectangular envelopes having two panels connected together along three side edges and open along a fourth side edge. The extractor comprises means for successively advancing envelopes along a predetermined path to a cutter assembly which cuts each envelope along lines of severance which extend from said fourth side edge and across the envelope whereby to separate one envelope panel from the other along opposite connected edges to leave the contents thereof in juxtaposition between the panels. Separating means receives the severed envelope and its contents from the cutter assembly and grips and moves one panel in a direction generally away from the other of the panels and the contents of the envelope whereby to separate the contents from the severed envelope. An envelope opening machine embodying the invention includes an improved chadless cutter assembly which opens envelopes without producing chad or relatively small paper scrap.

DETAILED DESCRIPTION OF THE PREFERRED EMBODIMENT

Figures 1, 2, 3:
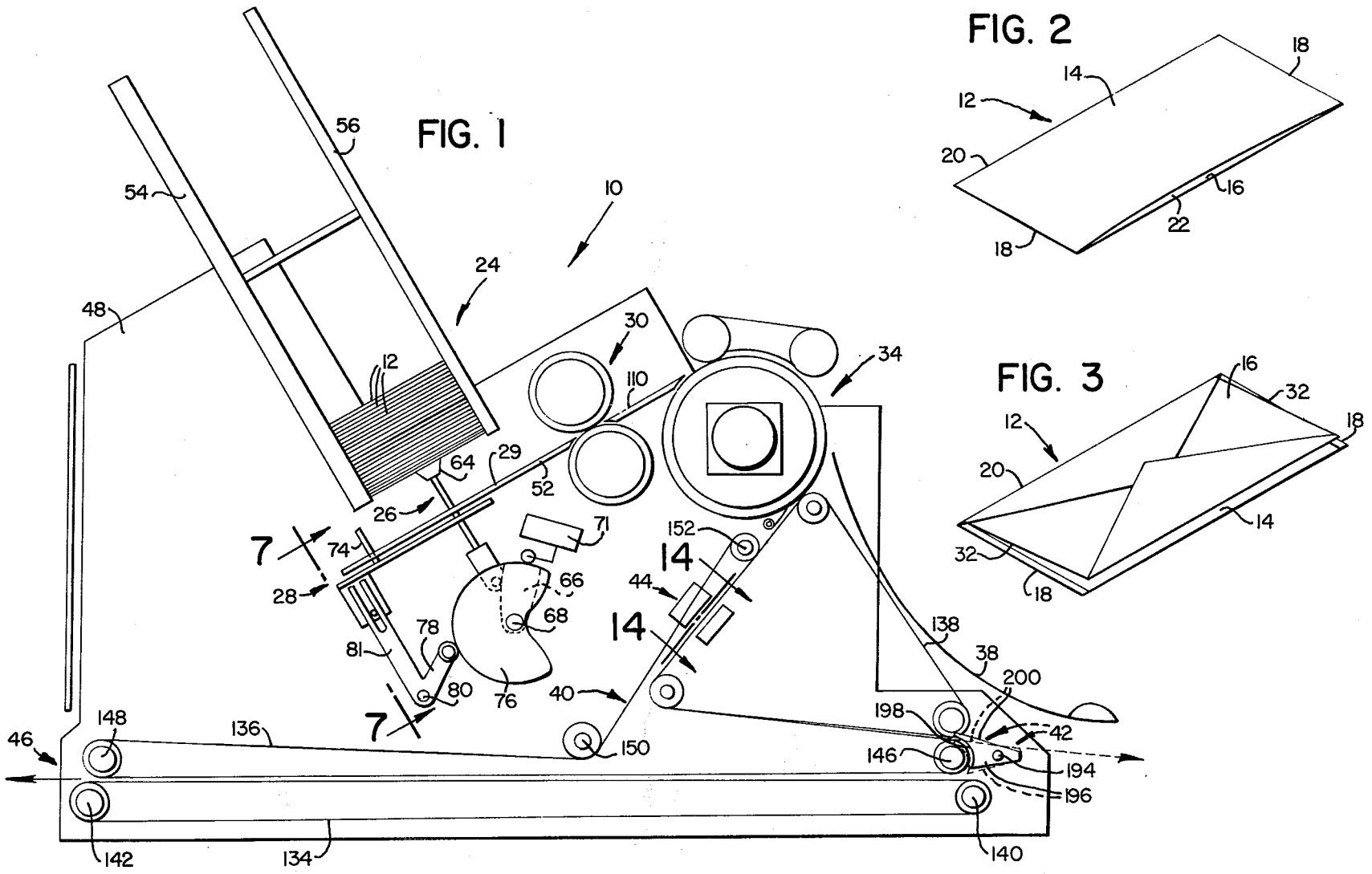
FIG. 1 is a somewhat schematic side elevational view of an extractor embodying the present invention.
FIG. 2 is a perspective view of a typical opened envelope of the type processed by the extractor of FIG. 1.
FIG. 3 is a perspective bottom view of the envelope of FIG. 2 after it has been partially processed by the extractor of FIG. 1.

Turning now to the drawings, an extractor for removing contents from previously opened envelopes and embodying the present invention is illustrated and designated by the reference numeral 10. The extractor 10 is particularly adapted to process sealed, generally rectangular envelopes which have been opened by a conventional envelope opening machine or the like which slits an envelope along one edge. A typical opened envelope ready for processing by the extractor 10 is indicated generally by the reference numeral 12 in FIG. 2. The envelope 12 has two panels 14 and 16 connected together along three side edges 18, 18 and 20 and defining an opening 22 along the fourth side edge of the envelope.

The illustrated extractor 10 is a table top unit and generally comprises an envelope magazine or input hopper designated generally by the numeral 24 for containing a stack of opened envelopes 12, 12. The envelopes are individually withdrawn in sequence from the hopper by a feed mechanism indicated generally at 26 which transfers each successive envelope 12 to an envelope transport designated generally by the numeral 28. The envelope transport 28 advances each envelope along a generally predetermined path 29 to a cutter assembly indicated generally at 30 which cuts the envelope inwardly of its opposite side edges 18, 18 to sever the connections between the panels 14 and 16 along the latter edges to leave the panel 16 connected to the panel 14 along only one long edge 20, as best shown in FIG. 3. Preferably, the cutter assembly is arranged to cut through only one of the panels, as for example, the panel 16 shown in FIG. 3, along lines of severance 32, 32 which extend across the latter panel. The cutter assembly 30 is preferably further arranged to cut upwardly through the lower panel of each envelope as it advances along the path 29 and it will be noted that the envelope 12, as it appears in FIG. 3, has been cut in the aforedescribed manner. A separating mechanism indicated generally at 34 receives each severed envelope from the cutter assembly 30, grips and releasably holds the severed lower panels 16 and moves it in a direction away from the upper panel 14 and the envelope contents which is initially disposed in juxtaposition between the two panels. A deflector or chute 38 at the front of the extractor 10 enters between and spreads the two panels as the envelope is advanced by the separating mechanism to an envelope conveyor mechanism indicated generally at 40. The conveyor mechanism defines two envelope discharge paths, one path terminating at the front and the other at the rear of the extractor 10. A two-position gate mechanism indicated generally at 42 cooperates with the conveyor mechanism to determine the path along which each severed, emptied envelope travels to a discharge point. Thus, when the gate mechanism is in one position, emptied envelopes are discharged at the rear of the extractor whereas when the gate is in its other position, emptied envelopes are ejected from the front of the machine and toward the machine operator. The position of the gate may be manually controlled by an operator, or, if desired, an automatic detection device such as indicated generally at 44 may be provided for moving the gate 42 from one to the other of its positions in response to malfunction of the apparatus, as will be hereinafter further described.

Figure 4:
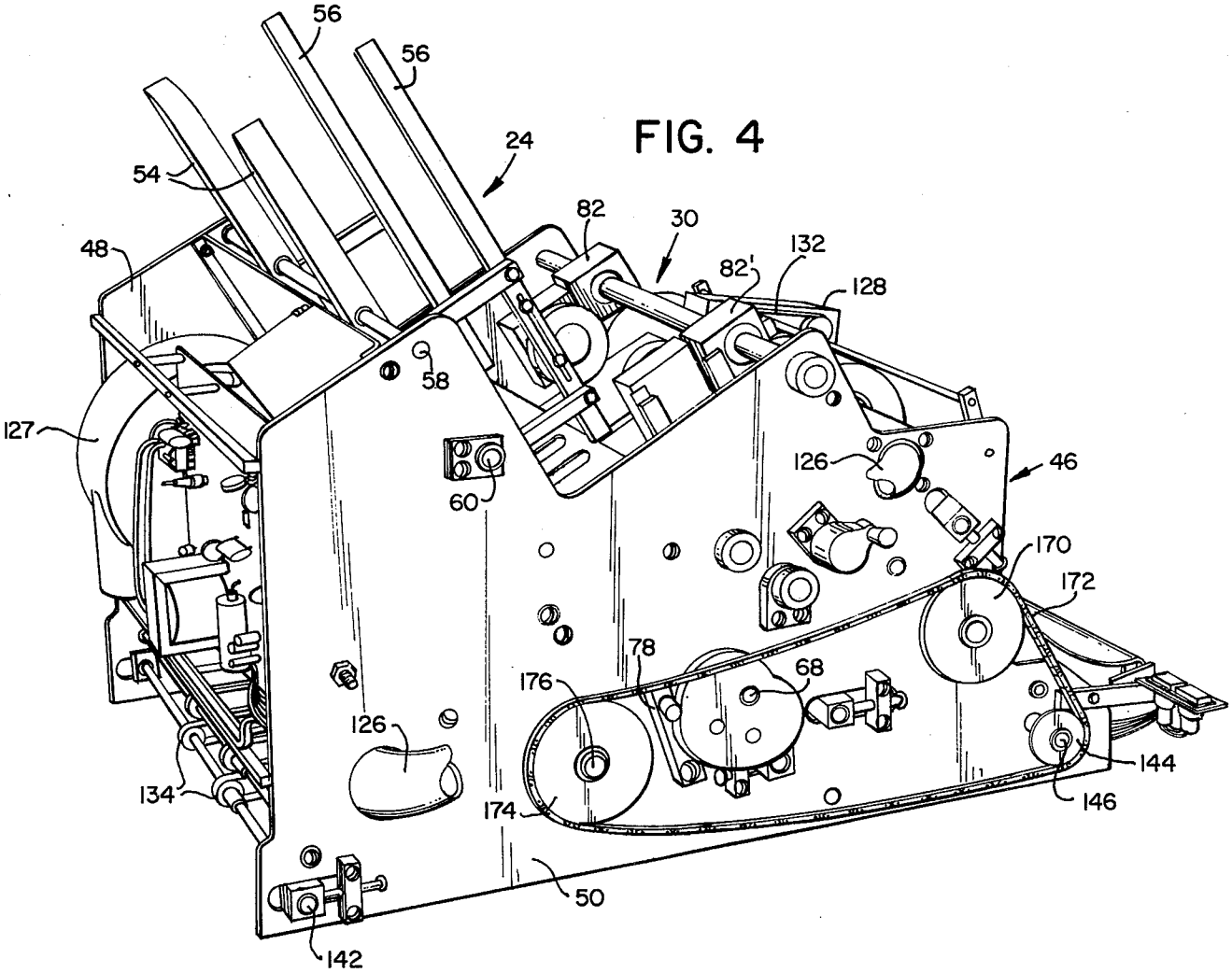
FIG. 4 is a perspective view of the extractor of FIG. 1 as viewed from above looking toward the left side of the machine.
Figure 5:
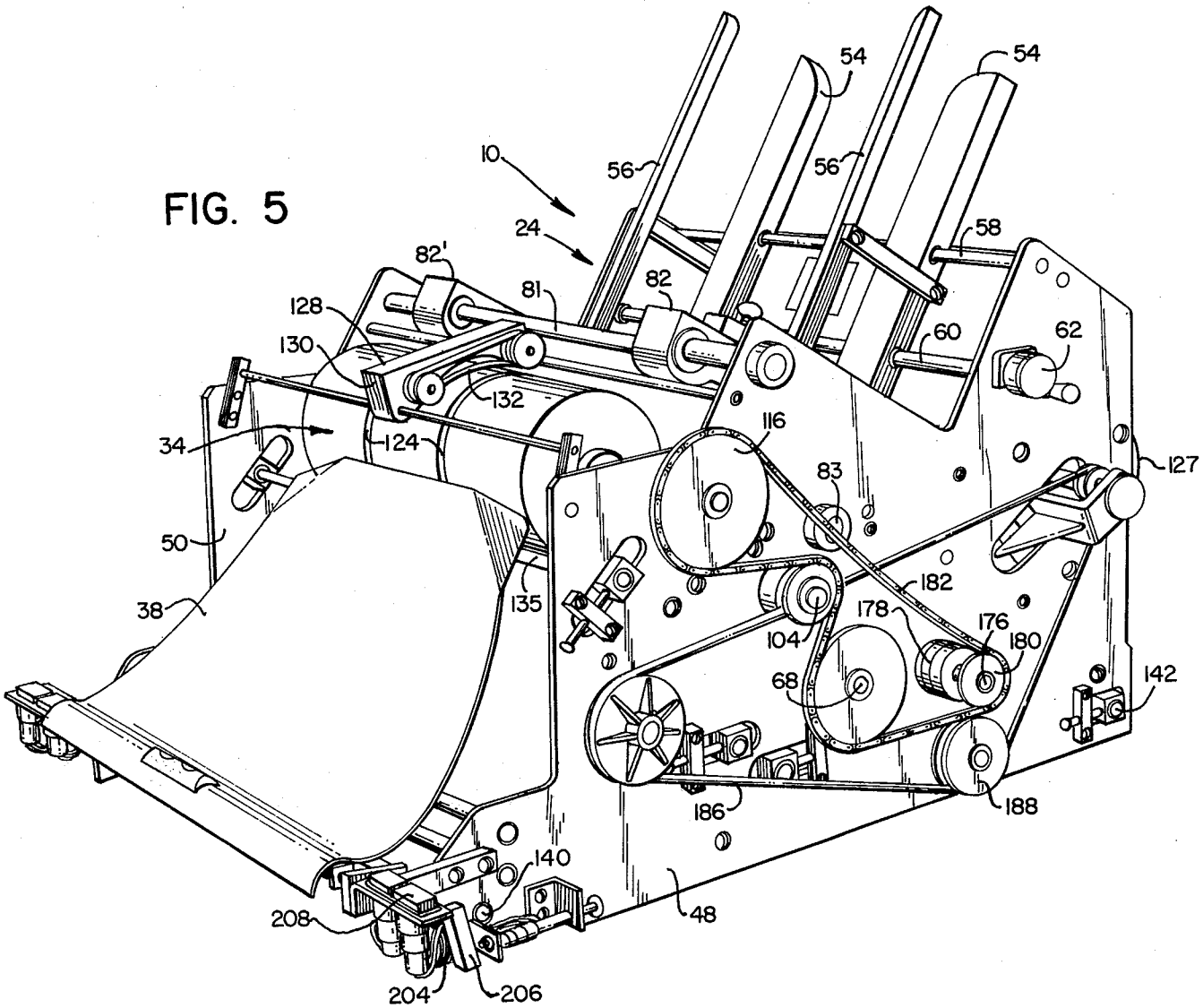
FIG. 5 is a perspective view of the extractor as viewed from above looking toward the right side of the machine.
Figure 8:
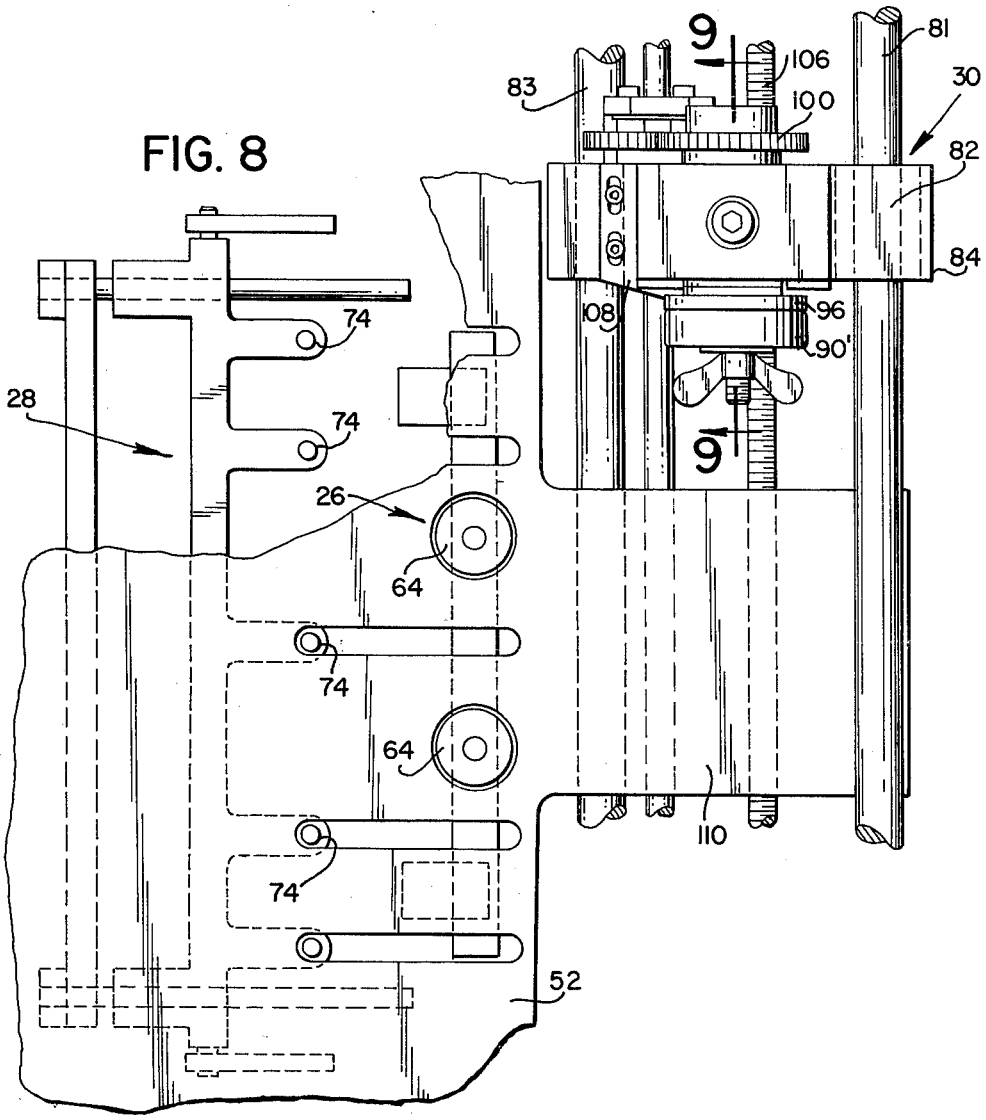
FIG. 8 is a fragmentary plan view of the extractor.

Considering now the extractor 10 in further detail, it has a frame indicated generally at 46 which includes right and left side members 48 and 50 connected in transversely spaced relation by a plurality of tie rods and an acceleration plate 52 which extends therebetween and as best shown in FIG. 8. The plate 52 is inclined in a forward and upward direction and has an upward facing envelope supporting surface which defines a portion of the path 29. The hopper 24 is supported generally above the plate 52 and comprises a pair of elongated rear support members 54, 54 which generally define the rear of the hopper. Each support member 54 carries a side rail 56 which defines an associated side of the hopper as best shown in FIGS. 4 and 5. The rear support members 54, 54 are slidably received on a tie rod 58 and further supported on the frame by an adjustment screw 60 which has right and left hand threaded portions each of which respectively threadably engages an associated one of the rear support members 54, 54. The end portions of the adjustment screw are respectively journalled on the frame members 48 and 50. A crank 62 mounted on the right-hand end of the adjustment screw 60 is operable to move the support members 54, 54 transversely of the frame and generally toward and away from each other to adjust the width of the hopper 24 to accommodate various sizes of envelopes.

Figure 7:
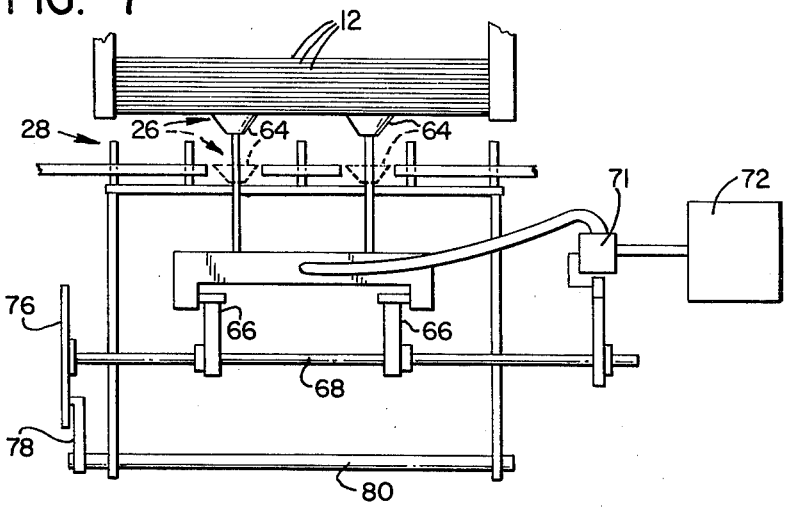
FIG. 7 is a somewhat enlarged fragmentary sectional view taken along the lines 7—7 of FIG. 1, and shown somewhat schematically.

Referring now particularly to FIGS. 1, 7 and 8, the feed mechanism 26, shown somewhat schematically, comprises a pair of vacuum pickers 64, 64 supported below the plate 52 for reciprocal movement through apertures in the plate, as shown in FIG. 8, and generally toward and away from the hopper 24 between an envelope pick-up position indicated by full lines and an envelope release position shown in broken lines in FIG. 7. The pickers 64, 64 are driven by a pair of cams 66, 66 mounted on a cam shaft 68 which is journalled on the side members 48 and 50 and extends therebetween. Another cam 70 mounted on the cam shaft 68 operates a control valve 71 connected in series between section pads carried by the pickers 64, 64 and a vacuum pump indicated by the numeral 72 and mounted on the frame 46. The envelope transport 28 generally comprises an accelerator or pusher mechanism which includes a plurality of transversely spaced pusher fingers 74, 74 mounted on a sliding pin carrier and received in slots formed in the plate 52. Another cam 76 mounted on the cam shaft 68 cooperates with a follower lever 78 mounted on a rocker shaft 80 to rock another lever 81 connected between the shaft 80 and the pin carrier to impart reciprocal movement to the pusher fingers 74, 74 generally toward and away from the cutter assembly 30.

Figure 9:
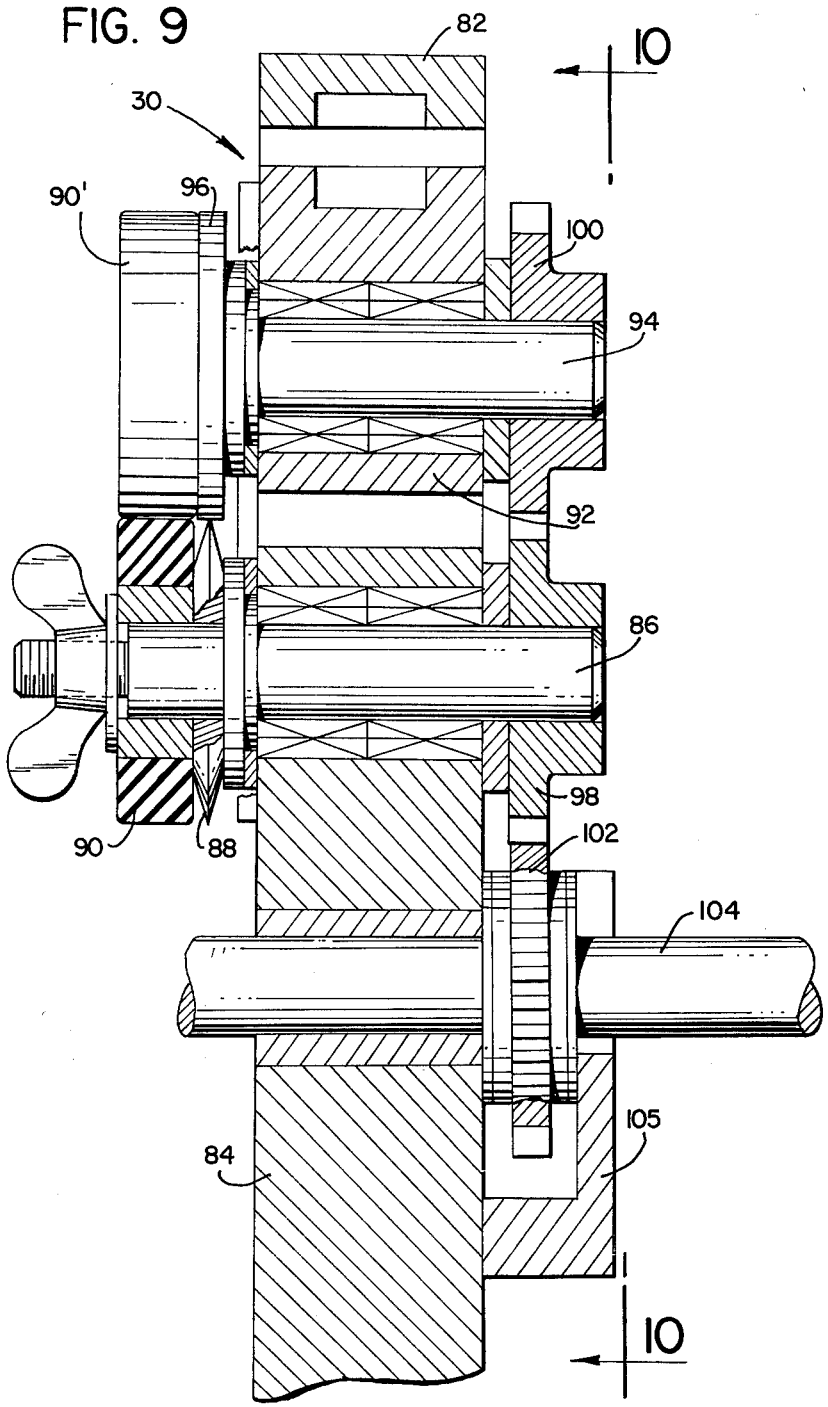
FIG. 9 is a sectional view taken generally along the lines 9—9 of FIG. 8.
Figure 10:
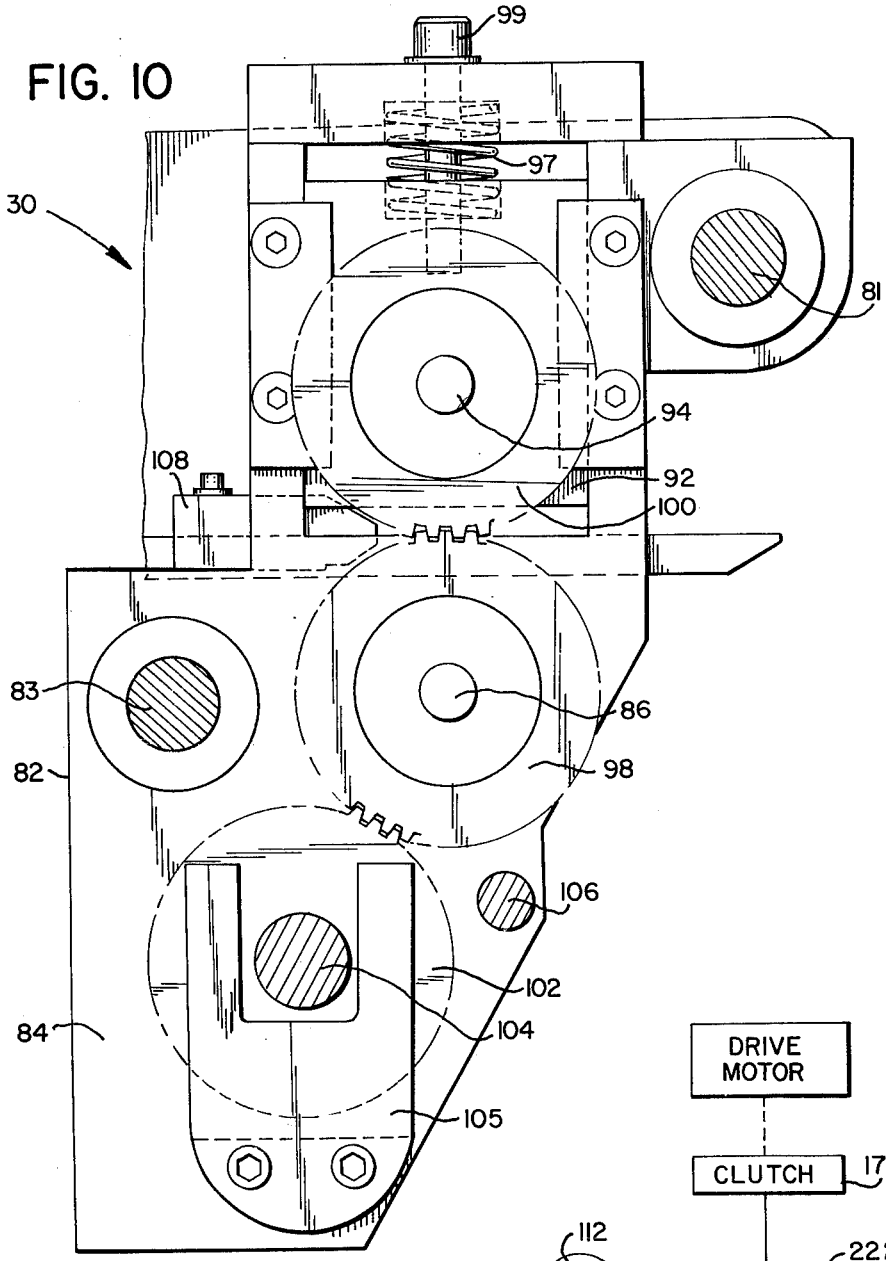
FIG. 10 is a sectional view taken along the line 10—10 of FIG. 9.

The cutter assembly 30 generally comprises a pair of cutter units which include right and left hand units 82 and 82' mounted in transversely spaced relation on the frame to respectively engage and cut the opposite side edges 18, 18 of each envelope 12 as it advances along the path 29. Referring particularly to FIGS. 8, 9 and 10, a typical cutter unit 82 includes a cutter frame 84 supported for transverse movement relative to the extractor frame 46 by a pair of tie rods 81 and 83 connected between the side members 48 and 50. The cutter frame 84 has a cutter shaft 86 journalled therein which carries a cutter wheel 88 at its inner end. The shaft 86 also has a lower feed roller 90, made from rubber or like material, mounted at its inner end inward of the cutter wheel 88. An adjustable anvil block 92 slidably received in an upwardly extending slot in the frame 84 has an anvil shaft 94 journalled therein parallel to the shaft 86. At its inner end, the anvil shaft 94 carries an anvil wheel 96 spaced slightly above the cutter wheel 88 and arranged to cooperate with the cutter wheel to define a nip. An upper feed roller 90' mounted on the inner end of the anvil shaft 94 cooperates with the lower feed roller 90. The anvil block 92 is biased downwardly by a compression spring 97 which acts between the anvil block 92 and the cutter frame 84. An adjustment screw 99 passes downward through the cutter frame 84 and threadably engages the anvil block 92 to facilitate adjustment of the space between the anvil wheel and the cutter wheel. Intermeshing gears 98 and 100 mounted on the outer ends of the shafts 86 and 94 drive the latter shafts in opposite directions. Each cutter unit 82, 82' is driven by an associated hubless gear 102 carried by a drive shaft 104 journalled on the retractor frame 46. Each gear 102 is arranged for axial sliding movement along its drive shaft 104 in driving engagement therewith. Each cutter unit 82, 82' has a gear retaining bracket 105 mounted on its frame 84 to maintain its associated drive gear 102 in driving engagement with the gear 98 mounted on its cutter shaft. A cutter adjustment screw 106 extends transversely of the extractor frame and has right and left-hand threaded portions respectively threadably engaging the right and left hand cutter units 82, 82'. A crank 107 mounted on the left-hand end of the adjustment screw 106 may be employed to simultaneously move the cutter units 82, 82' toward or away from each other to adjust the extractor 10 to accommodate envelopes of varying lengths. Each cutter unit 82, 82' carries an envelope edge guide 108 for engaging an associated envelope side edge 18 as the envelope is advanced into the cutter assembly 30 by the envelope transport 28. Each edge guide is arranged for transverse adjustment relative to its associated cutter unit 82, 82'. Another plate 110 disposed between the cutter units 82, 82' forms an extension of the accelerator plate 52 to further define the envelope 29. The latter plate is arranged to pivot upward in the manner of a trap door to facilitate ready access to the cutter wheels and lower drive rolls.

The separating mechanism 34 generally comprises a hollow cylindrical vacuum drum 112 supported at one end for rotation by a stub drive shaft 114 which extends through the right-hand side member 48 and carries a drive sprocket 116 at its outer end. The left-hand end of the drum 36 is supported by a journal block 118 mounted on the left-hand frame member 50. The block 118 has a passageway 120 which extends coaxially therethrough to communicate with the interior of the drum 112 and with vacuum ports 122, 122 which open through the peripheral surface of the drum. The drum 112 also has a pair of axially spaced apart annular grooves 124, 124 which open outwardly through its peripheral surface. A flexible air conduit 126 connects the passageway 120 to a blower 127 mounted at the rear of the frame 46 for drawing a vacuum on the drum 112.

Figure 6:
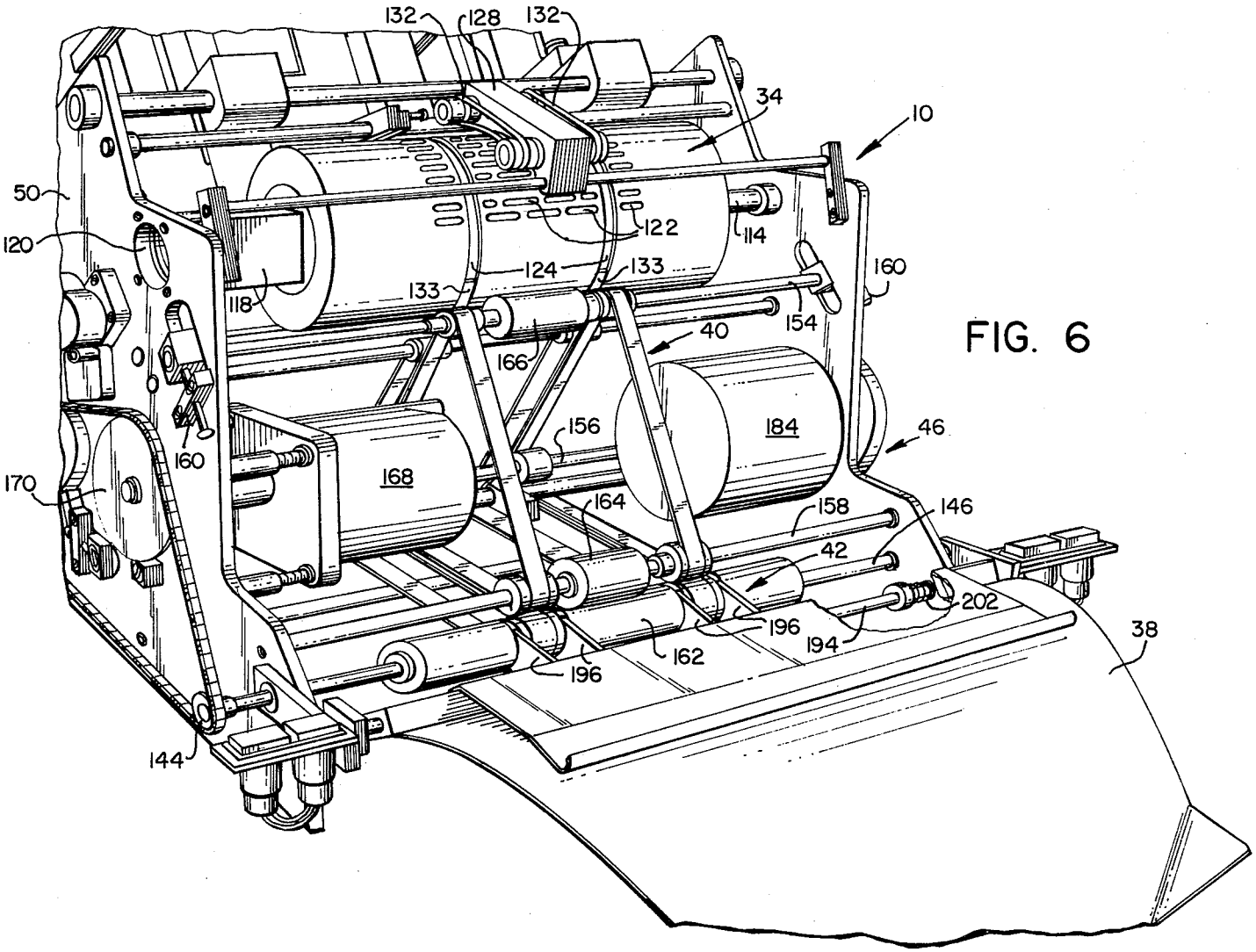
FIG. 6 is another perspective view of the extractor as viewed from above looking toward the front of the machine.

The separator mechanism 34 further includes the drum follower 128 which comprises a follower block 130 supported for sliding movement transversely of said drum 112 by a tie rod 131 which extends across the front of the frame, 46, as best shown in FIGS. 5 and 6. The drum follower carries a pair of endless belts 132, 132 mounted on pulleys journalled on the follower block 130 at opposite sides thereof. The belts 132, 132 are arranged to engage an associated portion of the peripheral surface of the drum 112 near the forward terminal end of the plate 110. A pair of strippers 133, 133, mounted in fixed position on another tie rod supported on the frame 46 generally below the drum 112 have free end portions which extend upward and into the annular grooves 124, 124, as best shown in FIGS. 6 and 10–12.

The chute 38 is mounted on the front end of the frame 46 to pivot between active and inactive positions, respectively shown in FIGS. 5 and 6. The chute is pivoted at its lower end and in its active position, FIG. 5, the upper end of the chute rests on a tie rod 135 near the drum 112 so that the upper end of the chute is disposed in close proximity to the peripheral surface of the drum. The chute is inclined in a forward and downward direction in generally tangential relation to the drum 112. The chute may be pivoted to its inactive position, as it appears in FIG. 6, to permit ready access to mechanisms located therebehind.

The envelope conveying mechanism 40, which receives each envelope advanced by the separator drum 112 preferably comprises three endless belt conveyors respectively indicated at 134, 136 and 138 and best shown in FIG. 1. Each of the conveyors includes a set of transversely spaced endless belts carried by pulleys mounted on shafts which are journalled on the side members 48 and 50 and extend therebetween. The conveyor 134 is supported on pulleys carried by shafts 140 and 142 and defines a generally horizontal path which extends from the front to the rear of the extractor 10. The conveyor 136, arranged in driving engagement with the conveyor 134, is supported by shafts 146, 148, 150 and 152. The shaft 146 comprises a drive shaft and has a drive pulley 144 mounted at its left-hand end. The conveyor 138 has a generally triangular configuration as viewed in FIG. 1, is supported by shafts 154, 156 and 158, and runs in driven engagement with an associated portion of the conveyor 136, substantially as shown. Thus, the drive shaft 146 comprises a common drive for the three belt conveyors which make up the conveyor system 40. Each of the latter conveyors has a pair of belt tensioners mounted at opposite ends of an associated one of its shafts. A pair of typical belt tensioners associated with the shaft 154 are indicated at 160, 160 in FIG. 6. It will be further noted that the shafts 146 and 158 respectively carry a pair of pinch rolls 162 and 164 which run in peripheral engagement. Another pinch roll 166 carried by a shaft 154 runs in peripheral engagement with an associated portion of the drum 112.

The extractor 10 is preferably driven by a variable speed DC motor 168 which drives a sprocket 170 at the left hand side of the extractor as shown in FIGS. 4 and 6. A chain 172 connects the sprocket 170, the conveyor drive sprocket 144 and another sprocket 174 carried by a shaft 176 which extends transversely of the frame 46. The opposite end of the shaft 176 is connected through an electric clutch 178 to another drive sprocket 180 at the right hand side of the machine, best shown in FIG. 5. A chain 182 driven by the sprocket 180 is drivingly connected to the cam shaft 68, the cutter drive shaft 104 and the drum 112 through associated sprockets. Thus, the feed mechanism 26, the envelope transport 28, the cutter assembly 30, the separating mechanism 34 and the conveyor mechanism 40 are driven in timed relation with each other. Another motor 184 mounted at the front of the machine, as best shown in FIG. 9, drives a belt 186 at the right hand side of the machine which runs over an idler pulley 188 and drives the blower 127.

The gate mechanism 42 includes a gate rocker shaft 194 located at the front of the machine forward of the conveyor shaft 146, as best shown in FIG. 1. A plurality of gate members 196, 196 are mounted in axially spaced series along the shaft 194. Each of the gates has an arcuate concave surface 198 facing in the direction of the conveyor 136 and generally complementing the forward end of the latter conveyor. Each gate member also includes a generally upwardly facing surface 200. The gate members 196, 196 are arranged to rock with the shaft 194 between a first or full line position and a second position indicated in broken lines in FIGS. 1 and 16. A torsion spring 202, which surrounds the right-hand end of the shaft 194, acts between a collar on the shaft and the side member 48 to bias each gate member 196, to its first position. A solenoid, 204, mounted on the side member 48 acts upon a lever 206 mounted on the gate rocker shaft to move the gate mechanism to its second position. A manually operated recall button 208 is provided for energizing the gate solenoid 204, however, the solenoid 204 may also be operated by the detection device 44.

Figure 16:
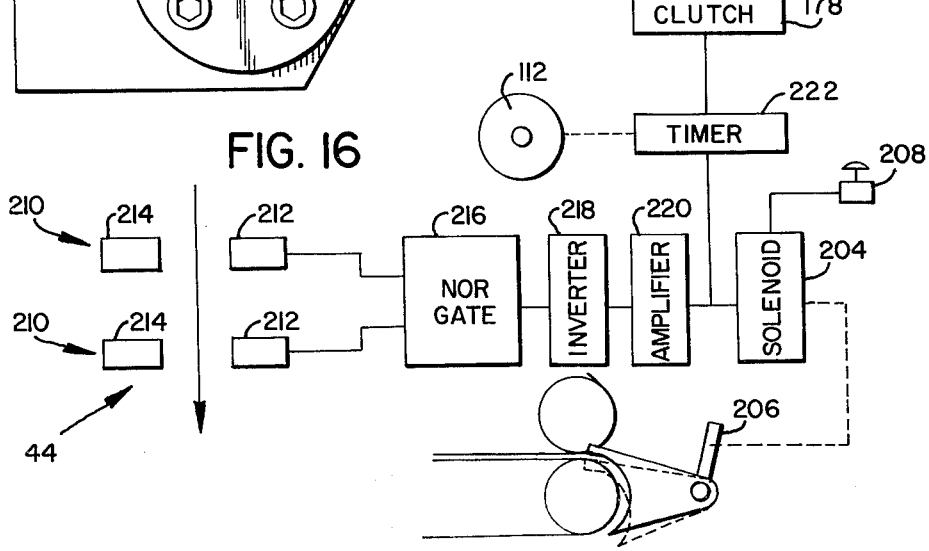
FIG. 16 is a somewhat schematic view of the contents detection mechanism.
Figure 14:
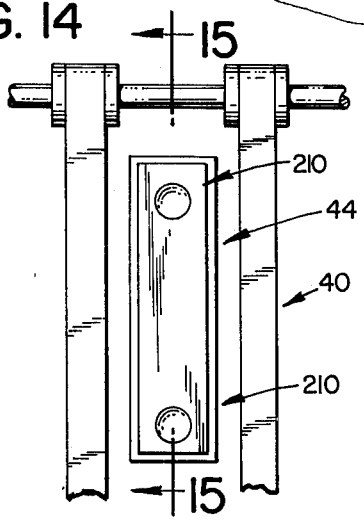
FIG. 14 is a somewhat enlarged fragmentary sectional view taken along the line 14, 14 of FIG. 1.
Figure 15:
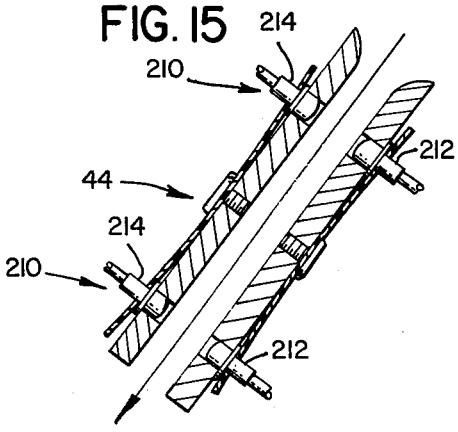
FIG. 15 is a fragmentary sectional view taken along the line 15, 15 of FIG. 14.

Considering now the automatic recall or contents detection device 44 in further detail and referring particularly to FIGs. 14–16, the detection device 44 is disposed in the path of envelope travel between the separating mechanism 34 and the gate mechanism 42. Preferably, and as shown, it is mounted in a fixed position relative to the common belt runs of the conveyor 135 and 138 and in the space between the transversely spaced belts which comprise the latter conveyors substantially as shown. The illustrated detection device comprises two sensing elements indicated generally at 210, 210. Each sensing element includes a photocell 212 and an opposing light source or light emitting diode 214 located in the takeway path of envelopes, after extraction. The sensing elements 210, 210 are spaced apart in the direction of envelope travel and each is arranged to respond to a predetermined condition of an envelope as, for example, the amount of infrared energy which passes through a single thickness of the paper which comprises the main portion of an opened, emptied envelope. When two thicknesses of paper are encountered as, for example, when an envelope seam or a document passes one sensing element 210 the change in the amount of energy received by the photocell 212 thereof is sufficient to trigger an associated circuit. The information imparted by the triggered circuit is transmitted to a logic circuit which determines if both photocells 212, 212 are simultaneously blocked. The sensing elements 210, 210 are so spaced along the envelope path that both elements will not be simultaneously blocked by the passage of an envelope seam, however simultaneous blockage of both sensing elements 210, 210 will indicate presence of a document or other undesirable material which may comprise the contents of the opened envelope. The gate solenoid operates in response to detection of a desired predetermined condition by the detection device to divert the envelope and document or the like to and along the second conveyor path where it is ejected at the front end of the machine. A logic circuit for accomplishing the aforedescribed purpose is illustrated somewhat schematically in FIG. 16 where the two sensing devices are shown connected to the input of a NOR gate 216. The NOR gate output is connected in series with an inverter 218, an amplifier 220 and the conveyor gate solenoid 204. Simultaneous detection of a desired predetermined condition by both sensing devices, as for example, the presence of two thicknesses of paper which simultaneously blocks both sensing elements 210, 210 will cause the conveyor gate solenoid 204 to be activated whereby to recall the envelope or eject it at the front of the machine and toward the operator. Preferably, drive mechanism which operates the envelope transport, the cutter assembly, and the separating mechanism is disabled, as by de-energizing the electric clutch 178, each time the gate solenoid 204 is operated, either manually or in response to the automatic recall device 44.

The illustrated clutch circuit includes a timer 222 for disengaging the clutch to stop the separating mechanism at a predetermined position wherein an envelope carried thereby is approaching its contents extracting position each time the conveyor gate solenoid 204 is operated.

After envelopes 12, 12 of a generally predetermined size have been opened along one long side edge thereof, as, for example, by slitting on a conventional envelope opening machine or the like, the envelopes are stacked into the input hopper 24 with the open edges thereof facing toward the front of the extractor 10. The hopper is then adjusted, as necessary, by operating the crank 62 to bring the side rails 56, 58 thereof into light contact with opposite side edges 18, 18 of the envelopes 12, 12. The rearwardly inclined arrangement of the hopper prevents coins or other loose contents from falling from the envelopes. A single envelope 12 is withdrawn from the hopper by the vacuum pickers 64, 64 which deposit the envelope on the acceleration plate 52 whereupon picker vaccum is cut-off by the valve 71. The transport device 28 then operates to advance the envelope along the path 29 to the cutter assembly 30. As the envelope is advanced, the pusher fingers 74, 74 square the envelope or align it with its longitudinal axis generally normal to its path of advance. The edge guides 108, 108 which have been adjusted to touch each side edge 18 of the advancing envelope to laterally align the envelope and guide each of its ends into the nip between a pair of upper and lower feed rolls 90, 90'. The edge guides 108, 108 are adjusted to accommodate an envelope of standard length thereby and control the distance from each envelope edge 18 to an associated cutter wheel 88. The distance inwardly from each side edge 18 to an associated line of severance is established by adjusting the edge guides 108, 108 and once the edge guides have been adjusted this distance cannot increase even though the length of the envelopes may vary. If a slightly longer than standard envelope is fed into the cutter assembly, the envelope will be bowed upwardly at its center as it is advanced through the cutter assembly by the feed rolls. If, however, the length of the envelope is substantially greater than standard, the envelope will be halted by engagement with the edge guides 108, 108 and will not pass into the cutter assembly.

Figure 11:
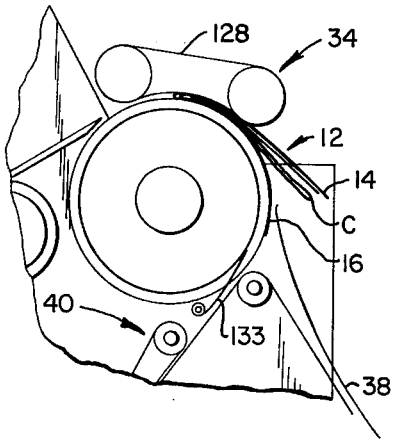
FIGS. 11, 12 and 13 are fragmentary schematic views of the extractor and show the sequence of separating contents from an envelope which has been cut by the extractor.
Figure 12:
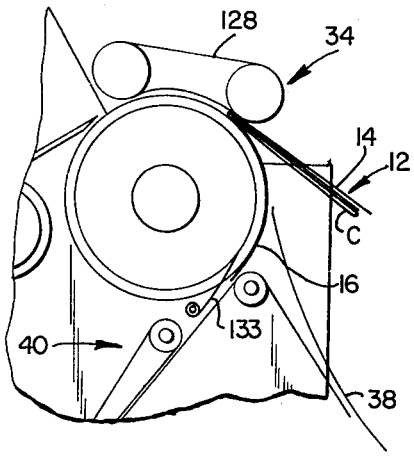
Figure 13:
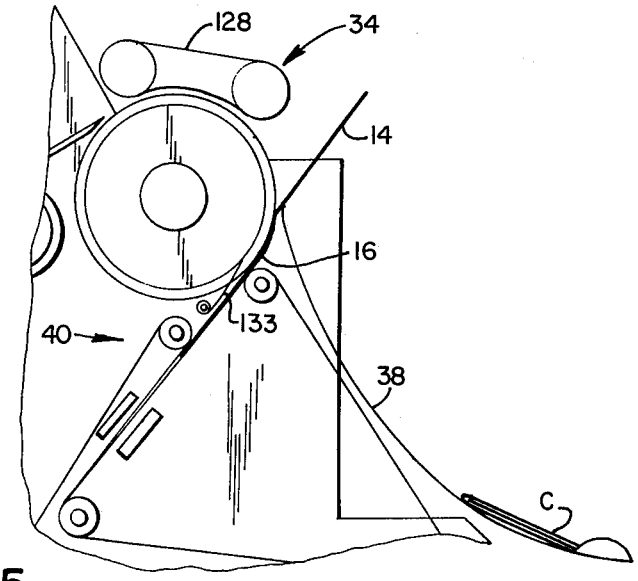

As each envelope 12 passes through the cutter assembly 30, the cutter wheels 88, 88 cut upwardly through only the lower envelope panel 16 due to the spacing between each cutter wheel 88 and its associated anvil wheel. The depth of each cut is determined by adjusting each cutter adjustment screw 99, so that each cutter wheel 88 cuts through all but one thickness of envelope material. Thus, the lower or back panel 16 of the envelope 12 is separated from its upper panel along its connected edges 18, 18 or more specifically along the lines of severance 32, 32 without trimming or removing material from the envelope. The cut is made on the down or lower side of the envelope to provide a lower cut-off panel in the envelope which is of substantially only one thickness and has a lesser resistance to flexure than the upper panel which includes small uncut portions at its opposite edges 18, 18. Thus, the lower panel more readily adapts to follow the contour of the separator drum 112. The severed envelope advanced by the cutting assembly 30 enters the nip between the separator drum 112 and the drum follower 128. As the envelope 12 leaves the cutter assembly it is timed so that the leading edge of its lower or back panel 16 overlies the vacuum ports 122, 122 which hold the panel down tightly against the peripheral surface of the drum. The drum follower 128 causes the somewhat stiffer upper panel 14 and the envelope contents to follow a portion of the peripheral surface of the drum. Referring now to FIGS. 11–13, it will be noted that as the envelope and its contents, indicated at C, leave the nip between the drum follower 128 and the drum 122 the contents C and the upper panel 14 tend to follow a tangential path relative to the drum 112. As the drum continues to rotate in a clockwise direction, as it appears in FIGS. 11–13, the upper end of the chute 38 enters the space between the two panels 14 and 16 below the contents C and catches the contents to direct it away from the emptied envelope which then follows the path of the drum 112. The upper end of the chute 38 acts to plow or fold the upper panel 14 toward a trailing position relative to the lower panel 16. As the drum 112 continues to rotate, the leading edge of the panel 16 is drawn into the nip between the pinch roll and the drum and is removed from the drum by the strippers 133, 133 which guide it along a generally tangential path relative to the drum and into the envelope conveyor system 40. The envelope 12 is conveyed through the document detection device 44 and if no document or contents is detected, the gate mechanism 42 remains in its first position so that the leading edge of the emptied envelope engages the arcuate surfaces 198, 198 on the gate members 194, 194 which divert the envelope along the common run between the conveyors 134 and 136 to a discharge point at the rear of the machine and into a trash container or the like (not shown). However, if the detection device 44 detects the presence of a document the logic circuit aforedescribed operates the conveyor gate mechanism 42 to shift the gate mechanism to its second or full line position as it appears in FIG. 1. In the latter position of the gate, the surfaces 200, 200 of the various gate members 196, 196 are aligned with the common run between the conveyors 138 and 138 so that the envelope and its contents are ejected from the front of the machine below the chute 38 and toward the operator. The extractor operator may also recall any desired envelope by operating the recall button 208 which energizes the solenoid 204 to change the position of the gate mechanism 42.

Referring now to FIG. 17 and FIGS. 19–21 an envelope opening machine embodying the present invention and indicated generally by the numeral 11 includes a chadless cutter assembly designated generally by the numeral 13. The machine 11 is particularly adapted to open sealed envelopes of conventional rectangular type which include front and back panels connected along associated edges. The cutter assembly 13 advances an envelope along a generally predetermined path and severs all but one of the panels inwardly of an associated connected edge and along a parting line or line of severance generally parallel to the latter edge. A typical envelope which has been opened by the machine 11 is indicated generally by the reference numeral 15 and has front and rear panels respectively indicated at 17 and 19. The envelope 15 has been opened by severing only the rear panel 19 along a parting line or line of severance defined by edges 21, 21 generally parallel to the connected upper edge of the envelope 15, the latter edge being indicated at 23.

The machine 11 is a table top unit and has a generally rectangular housing indicated generally at 25 which includes a raised central portion 27 which houses the cutter assembly 13, an envelope feed area at one end indicated generally at **31*a* and an envelope stacking area at its opposite end designated generally by the reference numeral 31*b*. The housing 25 further includes an upper deck plate 33 which defines an upwardly facing envelope support surface 35. A fence portion 37 extends upwardly from the deck plate 33 at the rear of the housing and defines a forwardly facing envelope guide surface 39 which extends across the machine from the feed area 31*a* and terminates at the stacking area 31*b*. The central portion 27 is spaced forwardly of the guide surface 39 and cooperates therewith to define an envelope receiving slot 41 into which envelopes to be opened are successively fed. The central portion 27 further defines an envelope abutment surface 43 which projects upwardly from the deck plate 33 and extends in a forward direction from the guide surface 39**.

Figure 20:
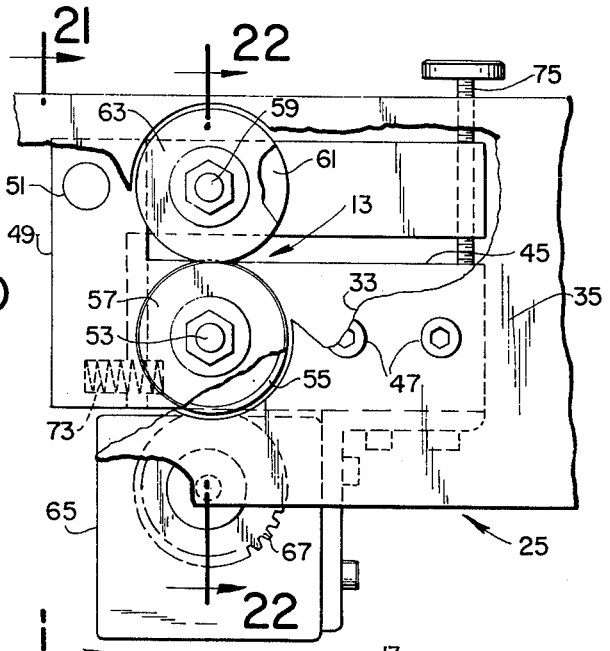
FIG. 20 is a somewhat enlarged fragmentary plan view of the machine of FIG. 17 and shows the deck plate and cutter assembly.
Figure 23:
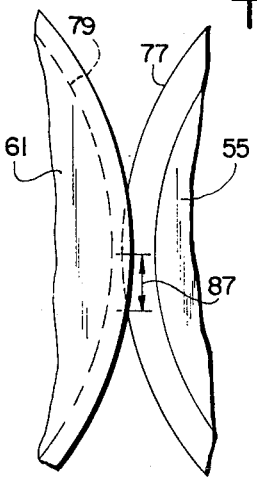
FIG. 23 is a fragmentary sectional view taken along the line 23—23 of FIG. 22.
Figure 21:
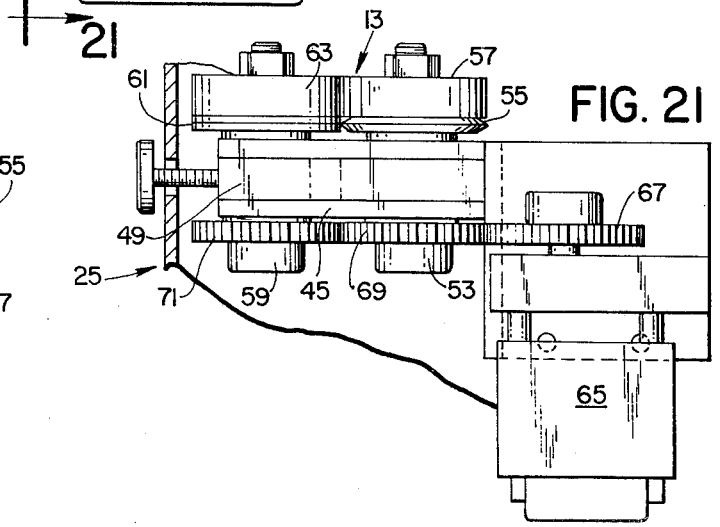
FIG. 21 is a somewhat enlarged fragmentary sectional view taken along the line 21—21 of FIG. 20.

Referring now particularly to FIGS. 20 and 21, the cutter assembly 13 generally comprises a rotary cutter unit which includes a frame mounted on and below the deck plate 33. More specifically, the frame includes a stationary cutter block 45 secured in fixed position to and below the deck plate by fasteners 47, 47 and a generally L-shaped movable part or anvil block 49 supported on the cutter block 45 by a pivot pin 51 for pivotal movement about a vertical axis and relative to the cutter block. A cutter shaft 53 journalled on the cutter block 45 extends upwardly through an opening in the deck plate 33 and carries a cutter wheel 55 which has a generally V-shaped peripheral surface. The shaft 53 also has a generally cylindrical feed roller 57, made from rubber or like material, mounted on its upper end above and in coaxial alignment with the cutter wheel 55. An anvil shaft 59 is journalled on the anvil block 49 near the pivot pin 51 and extends upwardly through the deck plate 33 in axially parallel alignment with the shaft 53. At its upper end the shaft 59 carries an anvil wheel 61 which has a generally V-shaped peripheral groove which cooperates with the peripheral edge portion of cutter wheel 55 to define a nip therebetween as will be hereinafter further discussed. Another cylindrical feed roller 63 made from rubber or like material and mounted on the upper end of the shaft 59 in coaxial alignment with the anvil wheel 61 cooperates with the feed roller 57. The cutter wheel 55 and its associated feed roller 57 is driven by a motor 65. Preferably, and as shown, the anvil wheel 61 and the feed roller 63 are also rotatably driven in an opposite direction from and in timed relation with the cutter wheel 55 and the feed roller 57. A gear train is provided to drive the cutter wheel, the anvil wheel and the feed rollers and includes a gear 67 carried by by the motors 65, a gear 69 mounted on the shaft 53 and another gear 71 mounted on the shaft 59 in meshing engagement with the gear 69.

A compression spring 73 acts between one leg of the L-shaped anvil block 49 and the cutter block 45, as best shown in FIG. 20, to bias the anvil wheel 61 and its associated feed roller 63 toward the cutter wheel 55 and its associated feed roller 57. an adjustment screw 75 threaded through the other leg of the anvil block 49 bears against the cutter block 45 and extends outwardly through the rear of the housing 25 to facilitate cutter adjustment, as will be hereinafter further described.

Figures 17, 18, 22:
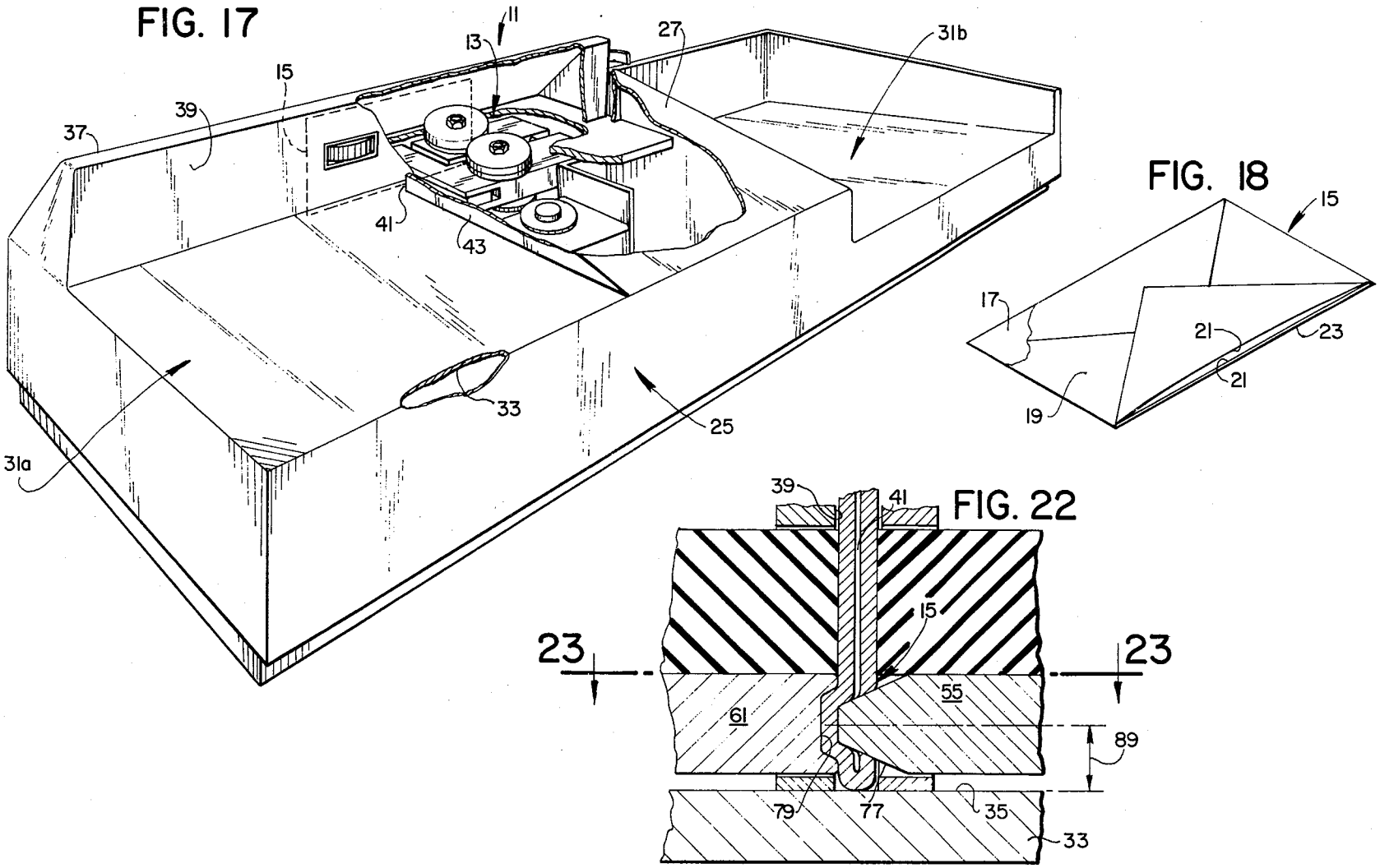
FIG. 17 is a perspective view of an envelope opening machine as viewed from above looking toward left side of the machine.
FIG. 18 is a perspective of a typical envelope of the type processed by the machine of FIG. 17 and shown after being opened by the machine.
FIG. 22 is a somewhat enlarged fragmentary sectional view taken along the line 22—22 of FIG. 20.

Further considering the cutter wheel 55 and the anvil wheel 61, and referring now to FIGS. 20–23, the cutter wheel has a generally V-shaped peripheral edge portion 77 received in an associated annular groove 79 in the peripheral surface of the anvil wheel 61. The cross sectional configuration of the groove 79 substantialy complements the cross sectional configuration of peripheral edge portion 77 as viewed in a radial plane and as best shown in FIG. 22. The adjustment screws 75 maintains the peripheral edge portion 77 in predetermined spaced relation to the anvil wheel 61 the latter spacing being adjusted to substantially equal the thickness of one of the envelope panels, such as the front panel 17 of the envelope 15. The groove 79 is preferably formed by running the cutter wheel 55 with its peripheral edge portion 77 in engagement with the peripheral surface of the anvil wheel 61 whereby a substantially complementary groove is worn into the anvil wheel by the cutter wheel. When the blade and anvil are properly conditioned or worn-in the gap between the side edges of the peripheral edge portion 77 and the associated side walls of the groove will be substantially uniform when the spacing between the cutter wheel and anvil wheel are properly adjusted. Eccentric or side-to-side run-out between the peripheral edge 77 and the associated side walls of the groove 79 is eliminated by driving both the cutter wheel 55 and the anvil wheel 61 and it is for this reason that a gear or drive train is provided for driving both the cutter and anvil wheels.

Figure 19:
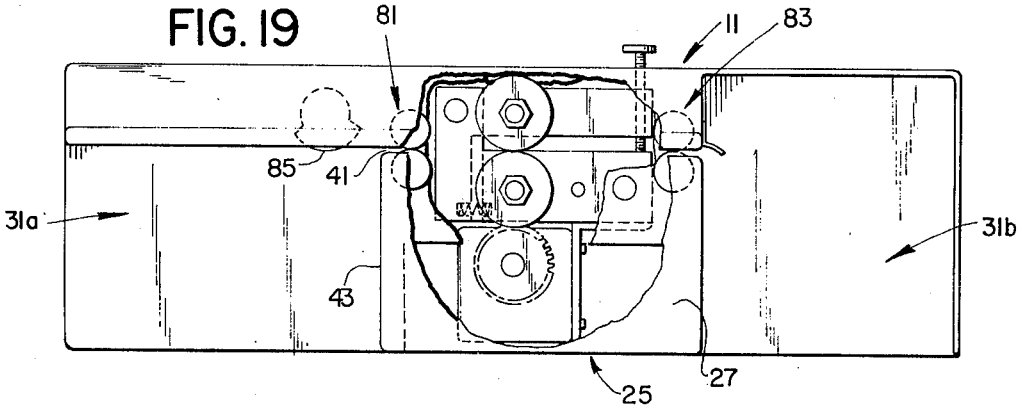
FIG. 19 is a somewhat reduced plan view of the machine of FIG. 17, a portion of the housing shown broken away to reveal structure therein.

The feed rollers 57 and 63 are provided for advancing each successive envelope through the cutter unit 13, however, preferably and as shown, additional sets of feed rollers indicated generally at 81 and 83 are provided for advancing each envelope along a predetermined path to and through the cutter unit from the feed area 31*a* to the stacking area 31*b* at the discharge end of the machine. The illustrated feeding mechanism also includes an eccentric feed roller indicated at 85 exposed in an opening in the fence 39, as best shown in FIGS. 17 and 19.

Envelopes to be opened are arranged in the feed area 31*a* on the envelope support surface in horizontaly stacked relation with side edges thereof engaging the abutment surface 43. A pusher or other suitable feeding mechanism (not shown) may be provided for urging the envelope stack in the feed area generally toward the fence 37. As each successive envelope engages the guide surface 39 the eccentric feed roller 85 engages an associated panel of the envelope and moves it into the slot 41 and into engagement with the feed rollers 81 which further advance it into the cutter unit 13 and into engagement with the feed rollers 57 and 63. In FIG. 1 a typical envelope 15 is shown being fed into the slot 41. As the advancing envelope moves into the nip between the cutter wheel 55 and the anvil wheels 61 it passes through a parting zone, indicated at 87 in FIG. 23, wherein the initial parting action occurs to form the parting line defined by the edges 21, 21. The peripheral edge of the cutting wheel 55 is spaced approximately 0.030 inches above the envelope support surface 35, as indicated at 89 in FIG. 22, so that the parting line or line of severance defined by the edges 21, 21 in FIG. 18 will be located approximately 0.030 inches from the envelope edge 23. Thus, the envelope 15 is opened below its contents, so that the contents will not be damaged by the opening operation. The force of the compression spring 73 is such that it provides sufficient pressure to cause the cutter wheel 55 to penetrate and "part" several thicknesses of paper. The depth that cutter wheel peripheral edge 77 extends into the anvil wheel groove 79 is controlled by the adjustment screw 75. The anvil wheel 61 is free to move away from the cutter wheel 55 against bias of the spring 73 if a paper clip, staple, or other hard object passes through the parting area 87. However, as soon as the foreign object passes through the parting area the cutter and anvil wheels return to their original adjusted position and "parting" continues. Before the envelope passes completely through the cutter unit 13 it engages the feed rollers 83 which further advance it to the stacking area 31*b* where suitable mechanism (not shown) may be provided for stacking or gathering the opened envelopes.

The "parting" principle hereinbefore described requires that there be no actual metal-to-metal contact between the cutter wheel and the anvil wheel and that one or both wheels be driven. In the event that only one of the wheel is driven the other wheel must be free to rotate. However, as previously noted, it is preferably that both wheels be driven to eliminate or at least minimize eccentric run-out between the cutter and anvil wheels. The parting of the paper along the parting line or line of severance might best be described as a controlled tearing which occurs as the envelope enters and passes through the parting zone 87, in FIG. 23. No dust or chips are produced by this parting operation and any slivers of paper which may be produced remain attached to the envelope to be discarded therewith. Thus, the aforedescribed parting operation is substantially chadless and leaves no undesirable, unsightly paper slivers which may be drawn into gears, pulleys or other moving parts of the machine.

It will now be evident that the cutter assembly 13 illustrated with reference to the envelope opener 11 may also be utilized in the extractor 10. Further, a cutter unit such as is utilized in the extractor 10 may also be employed in the envelope opener 11 and such modified forms of the machines 10 and 11 ae contemplated within the scope of the invention.

I claim:

1. A machine for processing an envelope including two panels having connected edges comprising means for advancing the envelope along a generally predetermined path, and cutter assembly for engaging the advancing envelope and severing only one of the panels inwardly of at least one associated connected edge thereof and along a line of severance generally parallel to the one associated connected edge, said cutter assembly including at least one rotary cutting unit, said cutting unit having a cutter wheel supported for rotation about an axis extending transversely of said path and an anvil wheel supported for rotation about an axis parallel to the axis of said cutter wheel and having an annular groove in its peripheral surface receiving an associated peripheral edge portion of said cutter wheel therein, said groove having a cross sectional configuration substantially complementing the cross sectional configuration of said associated peripheral edge as viewed in a radial plane, said peripheral edge portion and said groove defining a nip therebetween, and means for maintaining said associated peripheral portion in spaced relation to said anvil wheel within said groove.

2. The combination as set forth in claim 1 wherein said maintaining means comprises means for biasing said anvil wheel and said cutter toward each other.

3. The combination as set forth in claim 2 wherein said maintaining means comprises means for adjusting the spacing between said peripheral portion and said anvil wheel.

4. The combination as set forth in claim 2 wherein said cutting unit includes a frame having one part mounted in fixed position relative to said path and another part supported for movement relative to said one part, one of said wheels comprising said cutter wheel and said axial wheel being journalled on said one part and the other of said wheels being journalled on said other part.

5. The combination as set forth in claim 4 wherein said biasing means comprises a spring acting between said one part and said other part.

6. The combination as set forth in claim 4 wherein said maintaining means includes means for adjusting the position of said one part relative to said other part to adjust the spacing between said peripheral portion and said anvil wheel.

7. The combination as set forth in claim 6 wherein said adjusting means comprises an adjustment screw acting between said one part and said other part.

8. The combination as set forth in claim 1 wherein said cutter assembly comprises said advancing means.

9. The combination as set forth in claim 8 wherein said advancing means comprises a pair of feed rolls, one of said feed rolls being supported for coaxial rotation adjacent said cutter wheel and the other of said feed rolls being supported coaxially adjacent said anvil wheel, said feed rolls generally defining a nip therebetween.

10. The combination as set forth in claim 1 wherein said cutter assembly includes drive means for simultaneously rotating said cutter wheel and said anvil wheel in opposite directions.

11. The combination as set forth in claim 10 wherein said drive means comprises a gear train.

12. The combination as set forth in claim 1 wherein said machine comprises an envelope opener and said path is at least partially defined by an envelope guide surface disposed in a plane passing through said nip and envelope support surface disposed in a radial plane and axially spaced from said nip.

13. The combination as set forth in claim 1 wherein said machine comprises an extractor for removing contents from a generally rectangular envelope having two panels connected together along three side edges and having an opening along a fourth side edge and said cutter assembly comprises a pair of rotary cutter units disposed at transversely opposite sides of said path for engaging the advancing envelope and severing the one panel thereof inwardly of its opposite side edges leaving the one panel connected to the other panel along one side edge opposite its fourth side edge and the contents of the envelope in juxtaposition between the two panels.

14. The combination as set forth in claim 13 wherein said extractor includes separating means disposed to receive the severed envelope and its contents from said cutter assembly for engaging and releasably holding one of the panels and moving it in a direction generally away from the other of the panels and away from the contents, and means for directing the contents away from the severed envelope carried by the separating means whereby to separate the contents from the severed envelope.

15. In an extractor for removing contents from a generally rectangular envelope having two panels connected together along three side edges and having an opening along a fourth side edge thereof, the extractor having envelope transport means for receiving and advancing an envelope along a generally predetermined path, severing means disposed along said path to engage the advancing envelope for cutting it inwardly of its opposite side edges to sever the connections between the panels thereof along the opposite side edges thereof leaving one panel connected to the other panel along one side edge opposite its fourth side edge and the contents of the envelope juxtaposition between the two panels, separating means disposed to receive the severed envelope and its contents from said severing means for engaging and releasably holding one of the panels and moving it in a direction generally away from the other of the panels and away from the contents, the improvement wherein said severing means comprises a a pair or rotary cutting units disposed at transversely opposite sides of said path for cutting through only one panel of the envelope and along lines of severance extending across the one panel from its fourth side edge to one side edge of the one panel opposite the fourth side edge, each of said rotary cutter units including a cutter wheel supported for rotation about an axis extending transversely of said path and an anvil wheel supported for rotation about an axis parallel to the axis of said cutter wheel and having its peripheral surface spaced from the peripheral edge of said cutter wheel, said anvil wheel and its associated cutter wheel defining a nip therebetween.

16. The combination as set forth in claim 15 including means for directing the contents away from the severed envelope carried by the separating means whereby to separate the contents from the severed envelope.

17. The combination as set forth in claim 15 including a pair of transversely opposed envelope edge guides releasably secured in fixed position along said path for engaging the connected opposite side edges of the envelope to guide it into cutting engagement with the cutter wheels as the envelope is advanced along said path by said transport means, each of said edge guides being adjustable in a transverse direction.

18. The combination as set forth in claim 15 wherein said transport means includes means defining an envelope support surface, each said cutter wheel is journalled for rotation about an axis below said support surface, and each said anvil wheel is journalled for rotation about an axis above said support surface.

19. The combination as set forth in claim 15 wherein said cutting mechanism includes for adjustably positioning each anvil wheel relative to its associated cutter wheel to vary the spacing therebetween.

20. The combination as set forth in claim 19 wherein said means for adjustably positioning each anvil wheel includes means for biasing each anvil wheel toward its associated cutter wheel.

21. The combination as set forth in claim 15 wherein said severing means comprises a portion of said envelope transport means.

22. The combination as set forth in claim 15 wherein said separating means comprises a separator drum journalled for rotation about an axis extending generally transversely of said path having at least one vacuum port opening through the peripheral surface thereof and a drum follower for maintaining the envelope received by said separator drum in engagement with an associated portion of the peripheral surface of said drum as the envelope is advanced by said drum.

23. The combination as set forth in claim 22 wherein said drum follower comprises an endless belt.

24. In an extractor for removing contents from a generally rectangular envelope having two panels connected together along three side edges and having an opening along a fourth side edge thereof, the extractor having envelope transport means for receiving and advancing an envelope along a generally predetermined path, severing means disposed along said path to engage the advancing envelope for cutting it inwardly of its opposite side edges to sever the connections between the panels thereof along the opposite side edges thereof leaving one panel connected to the other panel along one side edge opposite its fourth side edge and the contents of the envelope in juxtaposition between the two panels, separating means disposed to receive the severed envelope and its contents from said severing means for engaging and releasably holding one of the panels and moving it in a direction generally away from the other of the panels and away from the contents, the improvement wherein said transport means includes an envelope supporting surface defining a portion of said path and said severing means comprises a cutting mechanism for cutting through only one panel of the envelope and along lines of severance extending across the one panel from its fourth side edge to one side edge of the one panel opposite the fourth side edge and including a pair of rotary cutter units disposed at transversely opposite sides of said supporting surface, each of said cutter units including a cutter frame, a cutter wheel journalled on said cutter frame for rotation about a transversely extending axis below said supporting surface, an anvil block supported on said cutter frame for movement relative thereto, a generally cylindrical anvil wheel journalled on said anvil block above said supporting surface for rotation about a transversely extending axis, said anvil wheel and said cutter wheel generally defining a nip therebetween, and means for adjustably positioned said anvil block relative to said cutter frame to vary the nip between said cutter wheel and said anvil wheel, means supporting said cutter units for transverse movement toward and away from each other and relative to said supporting surface, and means for simultaneously moving said cutter units in a transverse direction toward and way from each other.

25. The combination as set forth in claim 24 wherein each of said cutter units includes a pair of feed rolls, one of said feed rolls being journalled coaxially adjacent said cutter wheel, the other of said feed rolls being journalled coaxially adjacent said anvil wheel, said feed rolls generally defining a nip therebetween.

26. The combination as set forth in claim 24 wherein said extractor includes a tie rod extending transversely of the extractor frame, each of the cutter frames is slidably received on said tie rod, and said means for moving said cutter units comprises at transversely extending screw threadably engaging said cutter frames.

27. In an extractor for removing contents from a generally rectangular envelope having two panels connected together along three side edges and having an opening along a fourth side edge thereof, the extractor comprising envelope transport means for receiving and advancing an envelope along a generally predetermined path, severing means disposed along said path to engage the advancing envelope for cutting it inwardly of its opposite side edges to sever the connections between the panels thereof along the opposite side edges thereof leaving the one panel connected to the other panel along one side edge opposite its fourth side edge and the contents of the envelope in juxtaposition between the two panels, and separating means disposed to receive the severed envelope and its contents from said severing means for engaging and releasably holding one of the panels and moving it in a direction generally away from the other of the panels and away from the contents, the improvement comprising conveying means for receiving the severed envelope from said separating means and conveying it in a direction way from its contents, said conveying means defining a first path terminating at one location and a second path terminating at another location, said extractor including a conveyor gate movable between first and second positions relative to said conveying means, said conveyor gate in its first position cooperating with said conveying means to divert each envelope carried thereby to and along said first path, said conveyor gate in its second position cooperating with said conveying means to divert each envelope carried thereby to and along its second path, and means for moving said gate from one to the other of its positions.

28. The combination as set forth in claim 27 including deflecting means disposed to receive contents from said separating means.

29. The combination as set forth in claim 28 wherein said deflecting means comprises a plate mounted in fixed position relative to said separating means.

30. The combination as set forth in claim 29 wherein said separating means comprises a generally cylindrical separator drum and said plate comprises a chute arranged in generally tangential relation to said separator drum.

31. The combination as set forth in claim 27 wherein said conveying means comprises a plurality of endless belt conveyors and means for driving one of said belt conveyors, the other of said belt conveyors being driven by engagement with said one belt conveyor.

32. The combination as set forth in claim 27 wherein said gate is biased to one of its positions and said gate moving means comprises means for moving said gate from its one to its other position.

33. The combination as set forth in claim 27 wherein said gate moving means comprises manually operably means.

34. The combination as set forth in claim 27 wherein said means for moving said gate comprises detecting means mounted in fixed position relative to said conveying means between said separating means and said conveyor gate and responsive to a predetermined condition of an envelope advanced by said conveying means.

35. The combination as set forth in claim 27 including first drive means for driving said envelope transport means, said severing means and said separating means, second drive means for driving said conveying means, and means for disabling said first drive means in response to operation of said gate moving means.

36. In an extractor for removing contents from generally rectangular envelopes having front and back panels connected along side edges, the extractor having envelope transport means for sequentially advancing envelopes along a generally predetermined path, severing means disposed along said path to engage and cut each successive envelope to seperate one of said panels from the other along connected edges leaving the one panel connected to the other panel along one side edge normal to said path and the contents in juxtaposition between the panels, and separating means disposed to receive each successive severed envelope and its contents from said severing means for engaging and releasably holding one of the panels and moving it in a direction generally away from the other of the panels and away from the contents, the improvement comprising conveying means for receiving each severed envelope from said separating means, said conveying means defining a first path terminating at one location and a second path terminating at another location, a conveyor gate movable between first and second positions relative to said conveying means, said gate in its first position cooperating with said conveying means to divert each envelope carried thereby along said first path, said gate in its second position cooperating with said conveying means to divert each envelope carried thereby alobg said second path, means for moving convleyor gate from one to the other of its positions, detecting means mounted in fixed position relative to said conveying means between said separating means and said conveyor gate for operating said moving means in response to detection of a predetermined condition of a severed envelope carried by said conveying means.

37. The combination as set forth in claim 36 wherein said detecting means comprises a plurality of sensing devices mounted in spaced relation along the path of said conveying means, each of said sensing devices being responsive to said predetermined condition, and means for moving said gate in response to simultaneous response to said sensing devices to said predetermined condition.

38. The combination as set forth in claim 37 wherein said sensing devices comprise photo-electric sensing means responsive to thickness of material associated with the envelope and said means for moving said gate includes a logic circuit.

39. The combination as set forth in claim 36 including first drive means for driving said envelope transport means, said severing means, and said separating means, second drive means for driving said conveying means, and means for disabling said first drive means in response to operation of said gate moving means.

40. The combination as set forth in claim 39 wherein said disabling means comprises means for disabling said first drive means to stop said separating means at a predetermined position.

41. The combination as set forth in claim 40 wherein said disabling means comprises a clutch operably connected to said first drive means and operably in response to operation of said gate moving means.

* * * * *

UNITED STATES PATENT OFFICE
CERTIFICATE OF CORRECTION

Patent No. 4,016,708 Dated April 12, 1977

Inventor(s) John R. DeHart

It is certified that error appears in the above-identified patent and that said Letters Patent are hereby corrected as shown below:

Col. 5, line 20, after "envelope" insert --path--.

Col. 7, line 13, "135" should be --136--.

Col. 7, line 49, "input" should be --inputs--.

Col. 8, line 10, "58" should be --56--.

Col. 9, line 38, "138" (second occurrence) should be --136--.

Col. 10, line 60, "an" should be --An--.

Col. 11, line 40, "horizontaly" should be --horizontally--.

Col. 12, line 18, "wheel" (first occurrence) should be --wheels--.

Col. 12, line 38, "ae" should be --are--.

Col. 12, line 66, after "cutter" insert --wheel--.

Col. 13, line 8, "axial" should be --anvil--.

Col. 14, line 50, after "includes" insert --means--.

Col. 15, line 39, "positioned" should be --positioning--.

Col. 17, line 20, "alobg" should be --along--.

Col. 17, line 21, "convleyor" should be --conveyor--.

Col. 17, line 24, after "said" (second occurrence) insert --gate--.

UNITED STATES PATENT OFFICE

CERTIFICATE OF CORRECTION

Patent No. 4,016,708 Dated April 12, 1977

Inventor(s) John R. DeHart

It is certified that error appears in the above-identified patent and that said Letters Patent are hereby corrected as shown below:

Col. 18, line 7, "to" should be --of--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*